US009613514B2

(12) United States Patent
Torti

(10) Patent No.: US 9,613,514 B2
(45) Date of Patent: Apr. 4, 2017

(54) SYSTEMS AND METHODS FOR PROVIDING A SMART NOTIFICATIONS SYSTEM

(71) Applicant: Google Inc., Mountain View, CA (US)

(72) Inventor: Sara McKinley Torti, San Francisco, CA (US)

(73) Assignee: GOOGLE INC., Mountain View, CA (US)

( * ) Notice: Subject to any disclaimer, the term of this patent is extended or adjusted under 35 U.S.C. 154(b) by 0 days.

(21) Appl. No.: 14/737,250

(22) Filed: Jun. 11, 2015

(65) Prior Publication Data

US 2016/0364972 A1 Dec. 15, 2016

(51) Int. Cl.
*G08B 23/00* (2006.01)
*G08B 21/18* (2006.01)

(52) U.S. Cl.
CPC ..... *G08B 21/18* (2013.01)

(58) Field of Classification Search
CPC ..... G08B 17/107; G08B 25/006; G08B 19/00
USPC ..... 340/519, 517, 521, 522; 713/323
See application file for complete search history.

(56) References Cited

U.S. PATENT DOCUMENTS 6,167,448 A 12/2000 Hemphill et al.
6,256,664 B1 7/2001 Donoho et al.
6,353,814 B1 3/2002 Weng et al.
6,367,034 B1 4/2002 Novik et al.
6,591,094 B1 7/2003 Bentley et al.
6,781,509 B1 * 8/2004 Oppedahl ..... G08B 25/008 340/286.01
8,429,103 B1 4/2013 Aradhye et al.
8,610,558 B2 * 12/2013 Ryu ..... H04L 12/2825 340/517
8,644,702 B1 * 2/2014 Kalajan ..... H04N 21/64784 396/429
8,928,476 B2 * 1/2015 Jerhotova ..... G06F 17/2785 340/3.1
2003/0227381 A1 12/2003 Best et al.
2007/0179761 A1 * 8/2007 Wren ..... G06K 9/00771 703/2
2009/0033505 A1 2/2009 Jones et al.
2013/0154823 A1 6/2013 Ostrer et al.
2014/0197944 A1 7/2014 Felgate et al.
2014/0380264 A1 12/2014 Swamy et al.

* cited by examiner

*Primary Examiner* — Toan N Pham
(74) *Attorney, Agent, or Firm* — Morris & Kamlay LLP

(57) ABSTRACT

A system includes one or more sensors to gather information about an environment, a memory device that stores one or more computer executable components, and a processor to execute the computer executable components in the memory, including an event detection component to obtain information from the one or more sensors and identify whether a first level event has occurred based on the obtained information, a coalescence component to consolidate a plurality of events into a hierarchically higher-level, pre-defined coalesced event, and a communication component to send to one or more users a notification of a hierarchically highest level event determined to have occurred during a pre-determined time range.

26 Claims, 7 Drawing Sheets

100

600

| Time | Event | |
|---|---|---|
| 11:03:00 AM | Front door open | 710 |
| 11:03:03 AM | Individual in living room | 720 |
| 11:03:04 AM | Front door closed | 730 |
| 11:03:06 AM | Individual in living room identified as C | 740 |
| 11:03:07 AM | **C has arrived home** | 750 |
| 11:03:16 AM | Individual in kitchen | 760 |
| 11:03:18 AM | Item removed from counter | 770 |
| 11:03:19 AM | **C has picked up lunch** | 780 |
| | | |

700

FIG. 7

SYSTEMS AND METHODS FOR PROVIDING A SMART NOTIFICATIONS SYSTEM

BACKGROUND

A home, office, or other buildings may be equipped with a smart, networked system to provide automated control of devices, appliances and sub-systems, such as a heating, ventilation, and air conditioning ("HVAC") system, lighting system, home theater, entertainment system, and security system. The smart system may communicate system-related messages to a user of the system via a messaging component that sends notifications to the user, for example through text message, email, or other electronic messaging systems.

BRIEF SUMMARY

According to an embodiment of the disclosed subject matter, a system includes one or more sensors to gather information about an environment, a memory device that stores one or more computer executable components, and a processor to execute the following computer executable components in the memory: an event detection component to obtain information from the one or more sensors and identify whether a first level event has occurred based on the obtained information, a coalescence component to consolidate a plurality of events into a hierarchically higher-level, pre-defined coalesced event, and a communication component to send to one or more users a notification of a hierarchically highest level event determined to have occurred during a pre-determined time range.

According to an embodiment of the disclosed subject matter, a method includes obtaining information from one or more sensors about an environment, determining whether a first event has occurred based on the obtained information, determining whether a second event related to the first event occurred within a pre-determined time range of the first event based on the obtained information, determining whether a hierarchically higher level event comprising the first event and the second event has occurred, and communicating, to one or more users, a notification of a hierarchically highest level event determined to have occurred during a pre-determined time range.

According to an embodiment of the disclosed subject matter, means for obtaining information from one or more sensors about an environment, determining whether a first event has occurred based on the obtained information, determining whether a second event related to the first event occurred within a pre-determined time range of the first event based on the obtained information, determining whether a hierarchically higher level event comprising the first event and the second event has occurred, and communicating, to one or more users, a notification of a hierarchically highest level event determined to have occurred during a pre-determined time range, are provided.

Additional features, advantages, and embodiments of the disclosed subject matter may be set forth or apparent from consideration of the following detailed description, drawings, and claims. Moreover, it is to be understood that both the foregoing summary and the following detailed description are illustrative and are intended to provide further explanation without limiting the scope of the claims.

BRIEF DESCRIPTION OF THE DRAWINGS

The accompanying drawings, which are included to provide a further understanding of the disclosed subject matter, are incorporated in and constitute a part of this specification. The drawings also illustrate embodiments of the disclosed subject matter and together with the detailed description serve to explain the principles of embodiments of the disclosed subject matter. No attempt is made to show structural details in more detail than may be necessary for a fundamental understanding of the disclosed subject matter and various ways in which it may be practiced.

FIG. 7 shows an event log according to an embodiment of the disclosed subject matter.

DETAILED DESCRIPTION

Figure 1:
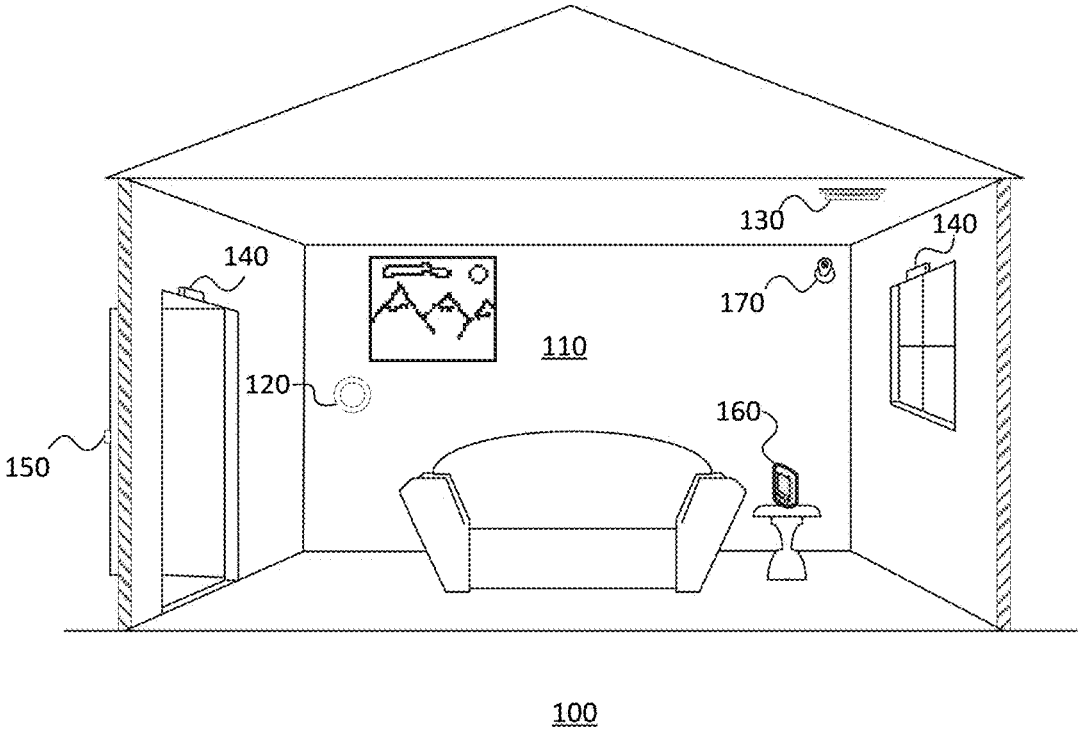
FIG. 1 shows a premises management system within a premises according to an embodiment of the disclosed subject matter.

Various aspects or features of this disclosure are described with reference to the drawings, wherein like reference numerals are used to refer to like elements throughout. In this specification, numerous details are set forth in order to provide a thorough understanding of this disclosure. It should be understood, however, that certain aspects of disclosed subject matter may be practiced without these specific details, or with other methods, components, materials, etc. In other instances, well-known structures and devices are shown in block diagram form to facilitate describing the subject disclosure.

The disclosed subject matter relates to a smart notification system that coalesces events to provide concise messages, reports, and the like, and that selects appropriate users to receive the messages and/or reports. The notification system may be integrated in a smart-home type of environment that includes sensors, interface components and one or more processing units to process data generated by the sensors.

Data from sensors may indicate the occurrence of different types of events. Some events may be isolated, but some may be more accurately characterized as being related, each being a part of a single, multi-step event. For example, sensors installed outside of a door, inside the door, and in an entry hall may detect three different events: a person opening the door, the person entering through the door, and the person walking down the hall. At least one problem in conventional systems is that these separately sensed events may be characterized separately and each trigger a notification or response from the system, instead of all three being recognized as part of a singular event: a person has entered the home.

The disclosed smart notification system may coalesce detected events into hierarchically higher level coalesced events to improve the efficiency of communications to the user. Coalesced events may be pre-defined by default or learned by the system logging events in an event log and recognizing patterns events that may serve as candidates for coalescence.

The disclosed smart notification system may also select which users receive system communications. Through learning and self-adjusting the system may increase the appropriateness of which users receive which communications. For example, if a user is a child, the system may learn not to send such a user notifications or reports regarding battery levels in a sensor, a cloud-service subscription about to expire, or an HVAC filter that needs changing.

The disclosed smart notification system may be implemented as a subsystem of a larger premises management system. In this capacity, the disclosed system may provide notifications for multiple other subsystems and correspondingly receive data from them. For illustrative purposes and to demonstrate the cross use of data among systems, the disclosed notification system will be described below as part of a smart home network environment, which will be referred to generically as a "premises management system."

A premises management system as described herein may include a plurality of electrical and/or mechanical components, including intelligent, sensing, network-connected devices that communicate with each other and/or may communicate with a central server or a cloud-computing system to provide any of a variety of security and/or environment management objectives in a home, office, building or the like. Such objectives, which may include, for example, managing temperature, controlling lights, managing alarms, notifying third parties of alarm situations, managing door locks, monitoring the premises, etc., will collectively be referred to as "premises management."

In addition to including the disclosed smart notification system, a premises management system may also include other subsystems to manage different aspects of premises management. For example, a security subsystem may manage the arming, disarming, and activation of alarms and other security aspects of the premises, a smart home environment subsystem may handle aspects such as light, watering and automated appliances, and an HVAC subsystem may handle adjusting temperature. Each subsystem may include devices, such as sensors, that obtain information about the environment. The premises management system may leverage data obtained in one subsystem to improve or expand the functionality of another subsystem and to provide additional data for the smart notification system.

The individual hardware components of the premises management system that are used to monitor and affect the premises in order to carry out premises management in general will hereinafter be referred to as "premises management devices." Premises management devices described may include multiple physical hardware and firmware configurations, along with circuitry hardware (e.g., processors, memory, etc.), firmware, and software programming that are capable of carrying out the objectives and functions of the premises management system. The premises management devices may be controlled by a "brain" component, as will be described further below, which may be implemented in a controller device or in one or more of the premises management devices.

FIG. 1 shows an example premises management system 100 that may include a smart notification system as a subsystem. Installed within a premises 110, the system 100 may include various other subsystems and multiple types of premises management devices, such as one or more intelligent, multi-sensing, network-connected thermostats 120, one or more intelligent, multi-sensing, network-connected hazard detection units 130, one or more intelligent, multi-sensing, network-connected entry detection units 140, one or more network-connected door handles 150, one or more intelligent, multi-sensing, network-connected controller devices 160, and one or more intelligent, multi-sensing, network-connected camera devices 170. Data from any of these devices may be used by the smart notification system to detect events, as well as for the devices' respective primary functions.

The premises management system 100 may be configured to operate as a learning, evolving ecosystem of interconnected devices. New premises management devices may be added, introducing new functionality, expanding existing functionality, or expanding a spatial range of coverage of the system. Furthermore, existing premises management devices may be replaced or removed without causing a failure of the system 100. Such removal may encompass intentional or unintentional removal of components from the system 100 by an authorized user, as well as removal by malfunction (e.g., loss of power, destruction by intruder, etc.). Due to the dynamic nature of the system 100, the overall capability, functionality and objectives of the system 100 may change as the constitution and configuration of the system 100 change. The types of events that may be detected by the smart notification system may also correspondingly change.

In order to avoid contention and race conditions among the interconnected devices, the handling of certain decisions, such as those that affect the premises management system 100 at a system level or that involve data from multiple sources, may be centralized in a "brain" component. The brain component may coordinate decision making across subsystems, the entire system 100, or a designated portion thereof. The brain component is a system element at which, for example, sensor/detector states converge, user interaction is interpreted, sensor data is received, subsystems are coordinated, and decisions are made concerning the state, mode, or actions of the system 100. Hereinafter, the system 100 brain component will be referred to as the "primary system processor." The primary system processor may be implemented in the controller device 160, for example, via software executed or hard coded in the single device, or it may be implemented in a "virtual" configuration, distributed among one or more premises management devices within the system using computational load sharing, time division, shared storage, and other techniques.

The primary system processor may be configured to execute software to control and/or interact with the subsystems and components of the premises management system 100. Furthermore, the primary system processor may be communicatively connected to control, receive data from, and transmit data to premises management devices within the system 100 as well as to receive data from and transmit data to devices/systems external to the system 100, such as third party servers, cloud servers, mobile devices, and the like.

Premises management devices (e.g., 120-150, 170) may include one or more sensors. In general, a "sensor" may refer to any device that can obtain information about its local environment and communicate that information in the form of data that may be stored or accessed by other devices and/or systems/subsystems. Sensor data may serve as the basis for inferences drawn about the sensor's environment and as the basis for identifying what will be referred to as "first level" events. A first level event is an occurrence in or around the premises that is detected by a sensor, or an occurrence determined based on data regarding a component controlled by the system. For example, the primary system processor may use data from an entry detection unit 140 to identify a first level event "front door opened," or data from a camera 170 to identify a first level event "individual in room." Similarly, a first level event based on data regarding a component controlled by the system could be, for example, "porch light turned off," or "sprinkler turned on."

A variety of sensors may detect first level events. A brief description of such sensors that may be included in the system 100 follows. The examples provided below are not intended to be limiting but are merely provided as illustrative subjects to help facilitate describing the subject matter of the present disclosure. It would be impractical and inefficient to list and describe every type of possible sensor, therefore, it should be understood that sensors in general are known in the art and deployment of sensors not specifically described herein will be within the capability of one with ordinary skill in the art.

Sensors may be described by the type of information they collect. In this nomenclature sensor types may include, for example, motion, smoke, carbon monoxide, proximity, temperature, time, physical orientation, acceleration, location, entry, presence, pressure, light, and sound sensors and the like. A sensor also may be described in terms of the particular physical device that obtains the environmental information. For example, an accelerometer may obtain acceleration information, and thus may be used as a general motion sensor and/or an acceleration sensor. A sensor also may be described in terms of the specific hardware components used to implement the sensor. For example, a temperature sensor may include a thermistor, thermocouple, resistance temperature detector, integrated circuit temperature detector, or combinations thereof.

A sensor further may be described in terms of a function or functions the sensor performs within the system 100. For example, a sensor may be described as a security sensor when it is used to determine security events, such as unauthorized entry.

A sensor may be operated for different functions at different times. For example, system 100 may use data from a motion sensor to identify a first level event "individual in room," or to determine how to control lighting in the premises 100 when an authorized party is present, or use the data as a factor to change a mode of a security system on the basis of unexpected movement when no authorized party is present. In another example, the system 100 may use the motion sensor data differently when a security subsystem is in an "away" mode versus a "home" mode, i.e., certain motion sensor data may be ignored by the security subsystem while the system 100 is in a "home" mode and acted upon when the security subsystem is in an "away" mode, leading to different events being generated by the security subsystem.

In some cases, a sensor may operate to gather information for multiple types of data sequentially or concurrently, such as where a temperature sensor is used to detect a change in temperature, as well as the presence of a person or animal, either of which may be identified as first level events. A sensor also may operate in different modes (e.g., different sensitivity or threshold settings) at the same or different times. For example, a sensor may be configured to operate in one mode during the day and another mode at night.

Multiple sensors may be arranged in a single physical housing, such as where a single device includes movement, temperature, magnetic, and/or other sensors. Such a housing may still be referred to as a "sensor" or premises management device. For clarity, sensors may also be described with respect to the particular functions they perform and/or the particular physical hardware used when such specification is beneficial for understanding of the embodiments disclosed herein.

Figure 2:
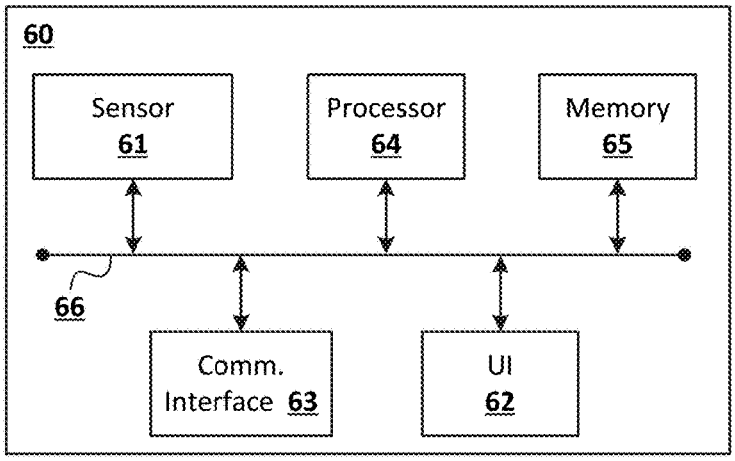
FIG. 2 shows a premises management device according to an embodiment of the disclosed subject matter.

FIG. 2 shows an example premises management device 60 including a processor 64, a memory 65, a user interface 62, a communications interface 63, an internal bus 66, and a sensor 61. A person of ordinary skill in the art would appreciate that various components of the premises management device 60 described herein can include additional electrical circuit(s) including components and circuitry elements of sufficient function in order to implement the embodiments of the subject disclosure. Furthermore, it can be appreciated that many of the various components listed above can be implemented on one or more integrated circuit (IC) chips. For example, a set of components can be implemented in a single IC chip, or one or more components may be fabricated or implemented on separate IC chips.

The sensor 61 may be an environmental sensor, such as a temperature sensor, smoke sensor, carbon monoxide sensor, motion sensor, accelerometer, proximity sensor, passive infrared (PIR) sensor, magnetic field sensor, radio frequency (RF) sensor, light sensor, humidity sensor, pressure sensor, microphone, imager, camera, compass or any other type of sensor that obtains or provides a type of information about the environment in which the premises management device 60 is located.

The processor 64 may be a central processing unit (CPU) or other type of processor and be communicably connected to the other components to receive and analyze data obtained by the sensor 61, transmit messages or packets that control operation of other components of the premises management device 60 and/or external devices, and process communication between the premises management device 60 and other devices. The processor 64 may execute instructions and/or computer executable components stored on the memory 65. Such computer executable components may include, for example, a primary function component to control a primary function of the premises management device 60 related to managing a premises, a communication component to locate and communicate with other compatible premises management devices, and a computational component to process system related tasks.

The memory 65 or another memory device in the premises management device 60 may store computer executable components and also be communicably connected to receive and store environmental data obtained by the sensor 61. A communication interface 63 may function to transmit and receive data using a wireless protocol, such as a WiFi, Thread, or other wireless interface, Ethernet or other local network interface, Bluetooth(R) or other radio interface, or the like may facilitate transmission and receipt of data by the premises management device 60 to and from other devices.

The user interface (UI) 62 may provide information and/or receive input from a user of system 100. The UI 62 may include, for example, a speaker to output an audible sound when an event is detected by the premises management device 60. Alternatively, or in addition, the UI 62 may include a light to be activated when an event is detected by the premises management device 60. The user interface may be relatively minimal, such as a liquid crystal display (LCD), light-emitting diode (LED) display, or limited-output display, or it may be a full-featured interface such as, for example, a touchscreen, touchpad, keypad, or selection wheel with a click-button mechanism to enter input.

Internal components of the premises management device 60 may communicate via an internal bus 66 or other mechanisms, as will be readily understood by one of skill in the art. One or more components may be implemented in a single physical arrangement, such as where multiple components are implemented on a single integrated circuit. Premises management devices 60 as disclosed herein may include other components, and/or may not include all of the illustrative components shown.

As previously mentioned, sensor 61 obtains information about the environment in or around the premises, and at least some of the information may be translated into data that may be used by the disclosed notification system to identify first level events. Through the bus 66 and/or communication interface 63, sensor data related to first level events and other functions may be transmitted to or accessible by other components or subsystems of the premises management system 100.

Figure 3:
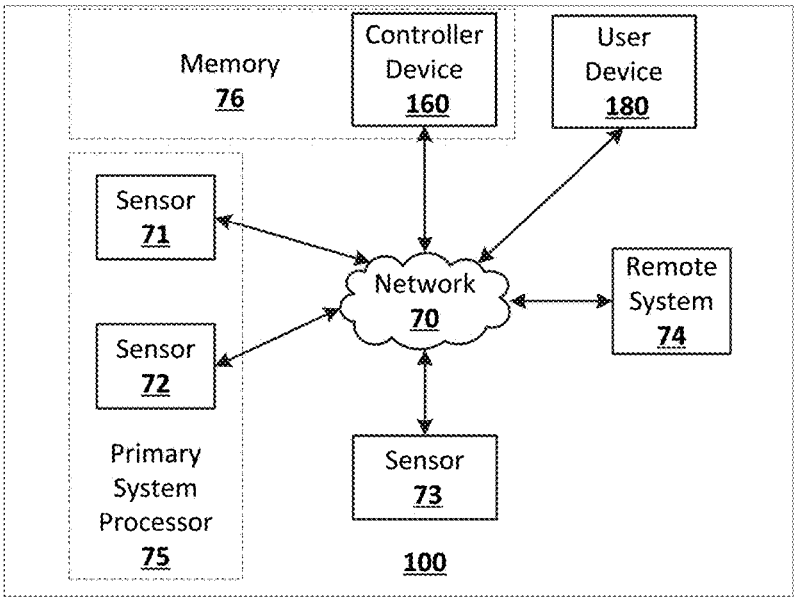
FIG. 3 shows a diagram of a premises management system according to an embodiment of the disclosed subject matter.

FIG. 3 shows a diagram example of a premises management system 100 which may include an embodiment of the smart notification system as disclosed herein. System 100 may be implemented over any suitable wired and/or wireless communication networks. One or more premises management devices, i.e., sensors 71, 72, 73, and one or more controller devices 160 (e.g., controller device 160 as shown in FIG. 1) may communicate via a local network 70, such as a WiFi or other suitable network, with each other. The network 70 may include a mesh-type network such as Thread, which provides network architecture and/or protocols for devices to communicate with one another. A user may interact with the premises management system 100, for example, using a user device 180, such as a computer, laptop, tablet, or mobile computing device, or using the controller device 160.

In the diagram of FIG. 3 a primary system processor 75 is shown implemented in a distributed configuration over sensors 71 and 72, and a memory 76 is shown implemented in controller device 160. However, the controller device 160 and/or any one or more of the sensors 71, 72, 73, may dynamically be configured to implement the primary system processor 75 and memory 76 or any other storage component required to store data and/or applications accessible by the primary system processor 75. The primary system processor 75 may receive, aggregate, analyze, and/or share information received from the sensors 71, 72, 73, and the controller device 160. Furthermore, a portion or percentage of the primary system processor 75 and/or memory 76 may be implemented in a remote system 74, such as a cloud-based reporting and/or analysis system.

The premises management system 100 shown in FIG. 3 may be a part of a smart-home environment which may include a structure, such as a house, office building, garage, mobile home, or the like. The system 100 can control and/or be coupled to devices inside or outside of the structure. One or more of the sensors 71, 72 may be located inside the structure or outside the structure at one or more distances from the structure (e.g., sensors 71, 72 may be disposed at points along a land perimeter on which the structure is located, such as a fence or the like).

Sensors 71, 72, 73 may communicate with each other, the controller device 160 and the primary system processor 75 within a private, secure, local communication network that may be implemented wired or wirelessly, and/or a sensor-specific network through which sensors 71, 72, 73 may communicate with one another and/or with dedicated other devices. Alternatively, as shown in FIG. 3, one or more sensors 71, 72, 73 may communicate via a common local network 70, such as a Wi-Fi, Thread or other suitable network, with each other and/or with a controller 160 and primary system processor 75. Sensors 71, 72, 73 may also be configured to communicate directly with the remote system 74.

Sensors 71, 72, 73 may be implemented in a plurality of premises management devices, such as intelligent, multi-sensing, network-connected devices, that can integrate seamlessly with each other and/or with a central processing system or a cloud-computing system (e.g., primary system processor 75 and/or remote system 74). Such devices may include one or more intelligent, multi-sensing, network-connected thermostats (e.g., "smart thermostats"), one or more intelligent, network-connected, multi-sensing hazard detection units (e.g., "smart hazard detectors"), and one or more intelligent, multi-sensing, network-connected entry-way interface devices (e.g., "smart doorbells"). The smart hazard detectors, smart thermostats, and smart doorbells may be the sensors 71, 72, 73 shown in FIG. 3. These premises management devices may be used by the disclosed smart notification system to detect first level events, but may also execute a separate, primary function.

For example, a smart thermostat may detect ambient climate characteristics (e.g., temperature and/or humidity) and may be used to control an HVAC (heating, ventilating, and air conditioning) system. In other words, ambient client characteristics may be detected by sensors 71, 72, 73 shown in FIG. 3, and the controller 160 may control the HVAC system (not shown) of the structure. However, unusual changes in temperature of a given room may also provide data that can supplement a determination of whether a recordable event has occurred, for example, detecting a rapid drop in temperature in a given room due to a broken in window.

As another example, a smart hazard detector may detect the presence of a hazardous substance or a substance indicative of a hazardous substance (e.g., smoke, fire, or carbon monoxide). Smoke, fire, carbon monoxide, and/or other gasses may be detected by sensors 71, 72, 73 shown in FIG. 3, and the controller 160 may control an alarm system to provide a visual and/or audible alarm to the user of the smart-home environment. However, the speaker of the hazard detector can also be used to announce notifications of events.

As another example, one or more intelligent, multi-sensing, network-connected entry detectors (e.g., "smart entry detectors") may be specifically designed to function as part of a security subsystem. Such detectors may be or include one or more of the sensors 71, 72, 73 shown in FIG. 3. The smart entry detectors may be disposed at one or more windows, doors, and other entry points of the smart-home environment for detecting when a window, door, or other entry point is opened, broken, breached, and/or compromised. The smart entry detectors may generate a corresponding detection signal to be transmitted to the controller 160, primary system processor 75, and/or the remote system 74 when a window or door is opened, closed, breached, and/or compromised. The detection signal may serve as the basis for a first level event to be processed by the notification system.

The smart thermostats, smart hazard detectors, smart doorbells, smart entry detectors, and other premise management devices of the system 100 (e.g., as illustrated as sensors 71, 72, 73 of FIG. 3) can be communicatively connected to each other via the network 70, and to the controller 160, primary system processor 75, and/or remote system 74.

Users of the premises management system 100 may interact with the system 100 at varying permission and authorization levels. For example, users may have accounts of varying class with the system 100, each class having access to different features.

Users may be identified as account holders and/or verified for communication of control commands and/or receipt of notifications from the smart notification system in different ways. For example, some or all of the users (e.g., individuals who live in a home) can register an electronic device, token, and/or key FOB with the premises management system 100. Such registration can be entered, for example, at a website, a system 100 interface (e.g., controller device 160), or a central server (e.g., the remote system 74) to bind the user and/or the electronic device to an account recognized by the system 100. Registered electronic devices may be permitted to control certain features of the system 100 and to receive notifications of events and status reports from the smart notification system. A user can use their registered electronic device to remotely control or communicate with the network-connected smart devices, such as when the user is at work or on vacation. The user may also use a registered electronic device to control the network-connected smart devices when the user is located inside the smart-home environment.

Alternatively, or in addition to registering electronic devices, the premises management system 100 may make inferences about which individuals live in the home and are therefore users and which electronic devices are associated with those individuals. As such, the system 100 may "learn" who is a user (e.g., an inferred authorized user) and may respond to communications from the electronic devices associated with those individuals, e.g., executing applications to control the network-connected smart devices of the system 100 or to receive messages from the smart notification system.

Once users (and their respective devices) have been registered or verified, the smart notification system may send notifications of events and status reports to the users via electronic messages, for example, sent via email, short message service (SMS), multimedia messaging service (MMS), unstructured supplementary service data (USSD), as well as any other type of digital messaging services and/or communication protocols.

In some instances the controller device 160 of the premises management system 100 may also receive messages from the smart notification system. The controller device 160 may be implemented using a general- or special-purpose computing device, and serve other purposes beyond receiving messages. A general-purpose computing device running one or more applications, for example, may collect and analyze data from one or more sensors 71, 72, 73 within the home and thereby function as controller device 160. In this case, the controller device 160 may be implemented using a computer, mobile computing device, mobile phone, tablet computer, laptop computer, personal data assistant, wearable technology, or the like. In another example, a special-purpose computing device may be configured with a dedicated set of functions and a housing with a dedicated interface for such functions. This type of controller device 160 may be optimized for certain functions and presentation, for example, including an interface specially designed to review an event log of the smart notification system and create coalesced events, as will be described further below.

The controller device 160 may function locally with respect to the sensors 71, 72, 73 with which it communicates and from which it obtains sensor data, such as in the case where it is positioned within a home that has a premises management system 100 installed therein. Alternatively or in addition, controller device 160 may be remote from the sensors 71, 72, 73, such as where the controller device 160 is implemented as a cloud-based system that communicates with multiple sensors 71, 72, 73, which may be located at multiple locations and may be local or remote with respect to one another.

Figure 4:
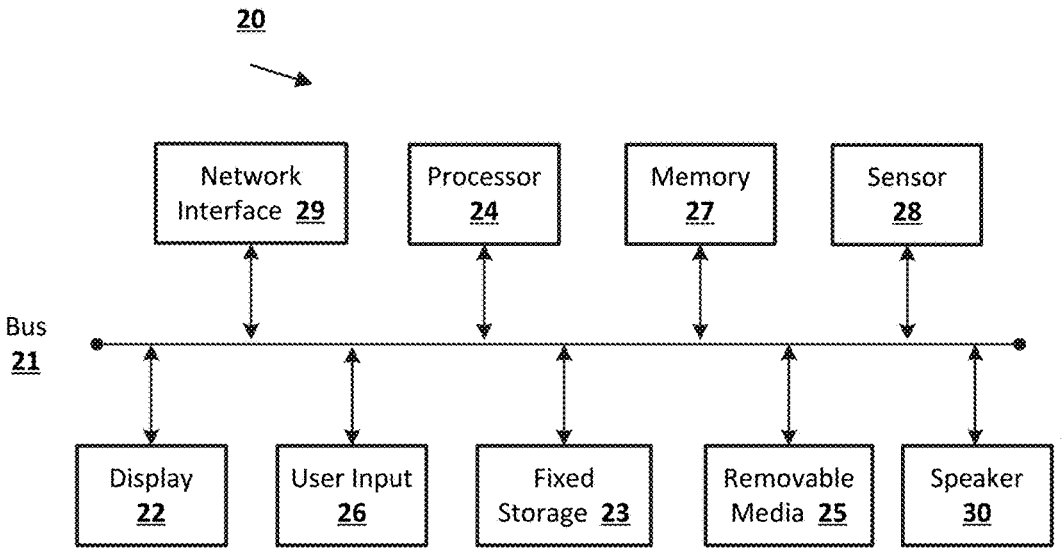
FIG. 4 shows a computing device according to an embodiment of the disclosed subject matter.

FIG. 4 shows an example computing device 20 suitable for implementing the controller device 160. The computing device 20 may include a bus 21 that interconnects major components of the computing device 20. Such components may include a central processor 24; a memory 27, such as Random Access Memory (RAM), Read Only Memory (ROM), flash RAM, or the like; a sensor 28, which may include one or more sensors as previously discussed herein; a user display 22, such as a display screen; a user input interface 26, which may include one or more user input devices such as a keyboard, mouse, keypad, touch pad, turn-wheel, and the like; a fixed storage 23 such as a hard drive, flash storage, and the like; a removable media component 25 operable to control and receive a solid-state memory device, an optical disk, a flash drive, and the like; a network interface 29 operable to communicate with one or more remote devices via a suitable network connection; and a speaker 30 to output an audible communication to the user. In some embodiments the user input interface 26 and the user display 22 may be combined, such as in the form of a touch screen.

The bus 21 allows data communication between the central processor 24 and one or more memory components 25, 27, which may include RAM, ROM, and other memory, as previously noted. Applications resident with the computing device 20 are generally stored on and accessed via a computer readable storage medium.

The fixed storage 23 may be integral with the computing device 20 or may be separate and accessed through other interfaces. The network interface 29 may provide a direct connection to the premises management system and/or a remote server via a wired or wireless connection. The network interface 29 may provide such connection using any suitable technique and protocol, as will be readily understood by one of skill in the art, including digital cellular telephone, WiFi, Thread, Bluetooth(R), near-field, and the like. For example, the network interface 29 may allow the computing device 20 to communicate with other components of the premises management system, other computers via one or more local, wide-area, or other communication networks, as described in further detail herein.

Figure 5A:
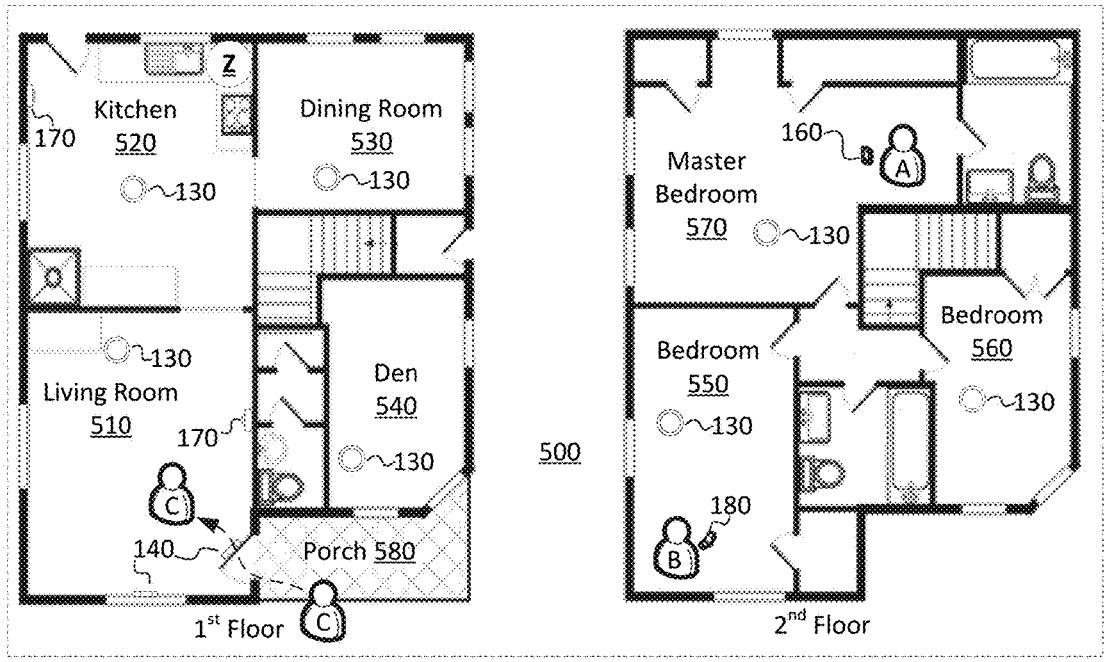
FIG. 5A shows a layout of a house including a configuration of a premises management system installed therein implementing the disclosed smart notification system according to an embodiment of the disclosed subject matter.

FIG. 5A shows an example layout of a two-floor house 500 including a configuration of a premises management system installed therein implementing the disclosed smart notification system. The house 500 includes a living room 510, kitchen 520, dining room 530, den 540, bedroom 550, bedroom 560, master bedroom 570, and porch 580.

A premises management system 100 installed in the house 500 includes an embodiment of the disclosed smart notification system. Referring to FIGS. 1 and 5, the system 100 may further include network-connected hazard detection units 130 installed throughout the house 500, network-connected entry detection units 140 installed at windows and doors throughout the house, a network-connected controller device 160, and network connected cameras 170. For simplicity and to avoid unnecessary clutter in the figure, only one window entry detection unit 140, one door entry detection unit 140, and one camera 170 are illustrated, i.e., in the living room 510, but it should be understood that entry detection units 140 may be installed at multiple windows and/or doors throughout the house 500, cameras 170 may be installed in other rooms and outside of the house 500, and that other premise management devices (e.g., smart thermostats, smart doorbells, etc.) as described above may be installed as part of the system 100.

In this example, users A, B, and C are registered users of the system 100. The smart notification system may therefore be configured to provide messages to users A, B and C that give notice of events detected in or around the house 500. The smart notification system may also be configured to provide messages regarding the state of the system 100, for example, maintenance reports on system components, reports on memory usage, or reports on third party services or subscriptions status. Furthermore, the smart notification system may determine which of users A, B, and C should receive which messages, how they should receive them and may "learn" to adjust and improve the selection of message recipients and delivery of messages.

Figure 5B:
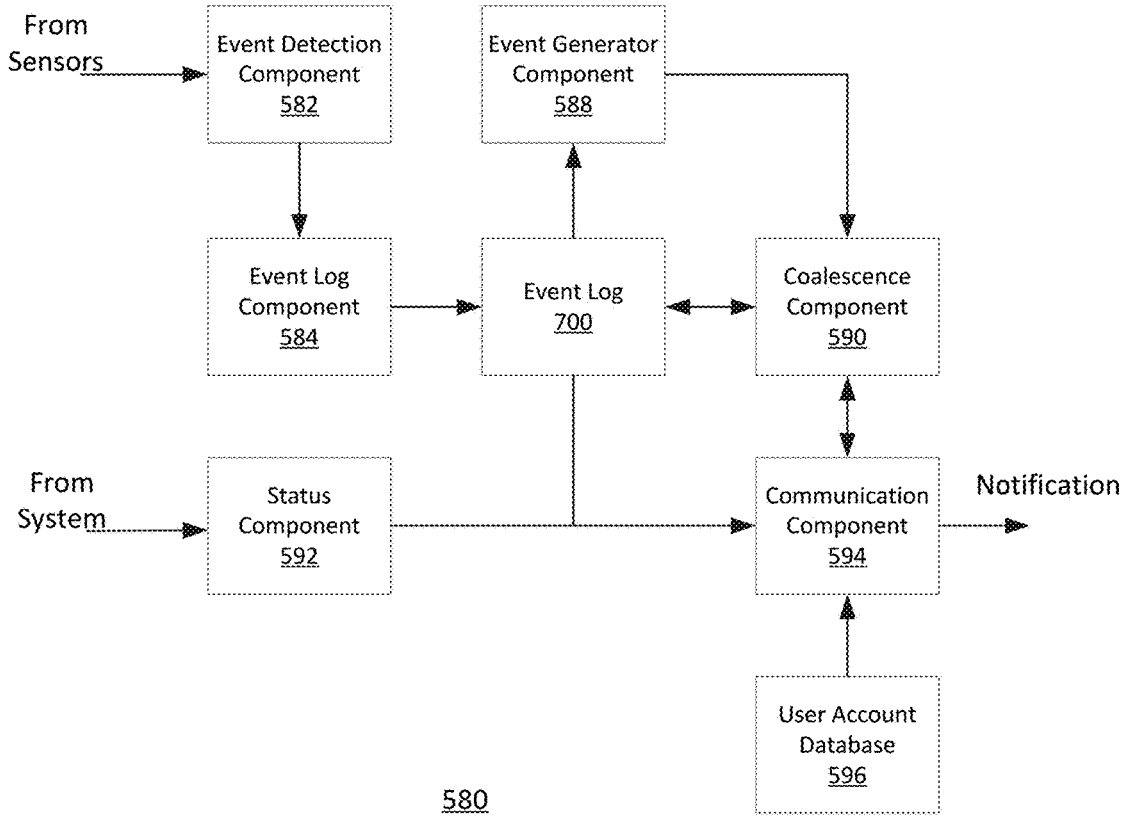
FIG. 5B shows a smart notification system that may be implemented within the system in the house of FIG. 5A according to an embodiment of the disclosed subject matter.

FIG. 5B shows an example of a smart notification system 580 that may be implemented within the system in the premises 500. The system 580 includes an event detection component 582, an event log component 584, an event log 700, an event generator component 588, a coalescence component 590, a status component 592, a communication component 594, and a user account database 596.

The event detection component 582 may obtain information from one or more sensors (e.g., entry detection units 140 and cameras 170 in FIG. 5A) and identify whether a first level event has occurred based on the obtained information. The event log component 584 may record a data log (i.e., event log 700) of detected events and coalesced events with corresponding times that the detected events and coalesced events occurred. The coalescence component 590 may consolidate a plurality of events stored in the event log 700 into a hierarchically higher-level, pre-defined coalesced event. The event generator component 588 may identify patterns in the event log 700 and create new coalesced event definitions based on the identified patterns. The status component 592 may generate a status report that provides information on a status of the system or a component of the system. The user account database 596 may include information regarding one or more authorized users of the system and various parameters associated with each account. The communication component 594 may send a notification to a user based on the data received from the coalescence component 590, event log 700, status component 592 and the user account data base 596. For example, the notification may include a hierarchically highest level event determined to have occurred in a given time range and may be sent to one or more users selected from the user account data base 596.

The event detection component 582, event log component 584, event log 700, event generator component 588, coalescence component 590, status component 592, communication component 594, and user account database 596 may be implemented, for example, via computer executable components or storage units stored in memory 76 or remote system 74 (FIG. 3) and accessed or executed by the primary system processor 75, or may be computer executable components or storage units stored and executed by remote system 74, or may be implemented using hardware such as a single integrated circuit (IC) chip, multiple ICs, an application specific integrated circuit (ASIC), or the like, with other circuitry functioning in a computing device 20 (FIG. 4) in communication with the system, such as the controller device 160 or a user device 180 (FIG. 3). Furthermore, a person of ordinary skill in the art would appreciate that such circuits or devices can include the described components, some of the components, and/or additional components/sub-components, according to various permutations and combinations of the foregoing. Sub-components can also be implemented as components communicatively coupled to other components rather than included within parent components (hierarchical). Additionally, it should be noted that one or more components may be combined into a single component providing aggregate functionality or divided into several separate sub-components, and any one or more middle layers, such as a management layer, may be provided to communicatively couple to such sub-components in order to provide integrated functionality.

Further aspects of the smart notification system 580 will now be described in greater detail with illustrative examples and scenarios.

In the scenario shown in FIG. 5A, users A and B are in the house 500 on the second floor. User A has the controller device 160 in the master bedroom 570 while User B has a registered cell phone 180 in the bedroom 550. User C approaches the house 500 via the front porch 580, opens the front door, enters the living room 510, and closes the front door.

The actions of User C may be detected by more than one device of the premises management system 100. For example, the entry detection unit 140 on the front door may detect the opening/closing of the door, and the camera 170 may detect the entry of an individual into the living room 510 and, using facial recognition or other techniques, may identify the individual as being User C. Each of these detections and the identification may be considered first level events, that is, an occurrence in or around the house that is determined directly based on data obtained from a sensor device. As previously explained, a first level event may refer to an event that is identified based upon the data obtained by one or more sensors managed by a premises management system. In contrast, second and higher level "coalesced" events as disclosed herein may be those that are created by coalescing or combining one or more events of any level together.

The smart notification system 580 may be configured to report certain events to one or more users of the system 100. For example, User A may wish to be notified via controller device 160 when User C has arrived at the home, or all of the users may wish to be notified via hazard detector speakers when an unauthorized user has entered the home. These desires may be communicated to the system as set notification objectives, for example, stored in a memory component of the system 100 (e.g., memory 76 in FIG. 3). The system 100 may include one or more preset notification objectives by default in addition to one or more user defined notification objectives, such as "notify A when C has come home," or "notify A and B when any individual enters the home while A and B are away," etc., as well as dynamically created notification objectives generated by the smart notification system.

As previously mentioned, the premises management system 100 may be a dynamic and evolving system, with network-connected components possibly being added, removed, or replaced over time. As such, the operational processing power and storage capacity of the system may correspondingly change, particularly when the primary system processor and memory are implemented by components of a local system. In view of this, the smart notification system 580 may attempt to gather information and pursue notification objectives in an efficient manner. For example, the event detection component 582 obtain information from sensors based on the time of day, e.g., if it is determined that a particular sensor detects relatively more information at certain times than at others. In another example, the event detection component 582 may obtain information from sensors that have a relatively high power level as opposed to sensors that have a relatively low power level, since well-powered devices may provide more reliable data.

In addition, the availability of various sensors may change from time to time, but the smart notification system 580 may continually attempt to achieve the set notification objectives. Since the state/availability of the system 100 sensors might not be guaranteed, in the example scenario of FIG. 5A any available sensor data may be useful to determine whether or not an event responsive to the notification objectives has occurred. In other words, the first level event detected by door entry detection unit 140, hereinafter referred to as "front door open," may be determined by the system 100 to be responsive to the notification objective "notify A when C has come home." The first level event "individual in living room" detected by the living room camera 170 may also be determined to be responsive. Finally, the first level event "front door closed," which may indicate the action or presence of an individual within or without, may also be determined responsive.

However, in the situation in which all three first level events of "front door open," "individual in living room," and "front door close" are detected and determined to be responsive to a notification objective, it is not efficient for the smart notification system 580 to notify the recipient three times regarding a single, multi-step event. To the contrary, repeated mechanical notifications of the same event may be considered an annoyance and cause the user to disable the feature. To mitigate against this situation, the smart notification system 580 may include a coalescence component 590 to coalesce one or more first level events into a "coalesced event."

Figure 6:
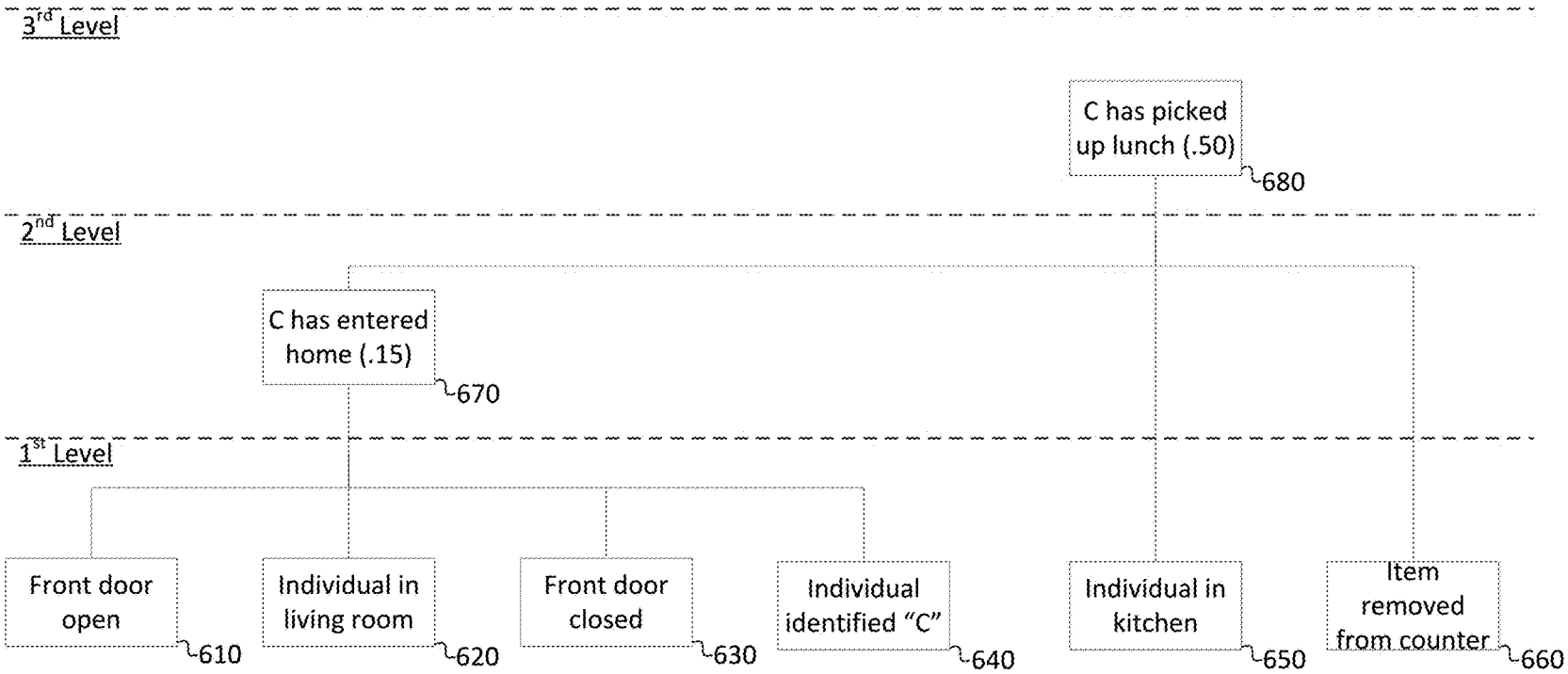
FIG. 6 shows a hierarchical tree defining coalesced events according to an embodiment of the disclosed subject matter.

Coalesced events may be hierarchically defined as a combination of one or more lower level events, where a lower level event may be a first level event or another coalesced event falling lower on the hierarchical tree than the subject coalesced event. FIG. 6 shows an example tree defining coalesced events. First level events 610-660 may be determined based on information directly obtained from a sensor, e.g., door entry detection unit 140, camera 170, or other sensors including motion sensors, microphones, etc. First level events may be coalesced into higher level events, for example, as events 610-640 are coalesced into a coalesced event 670, "C has entered home." Furthermore, coalesced events may be coalesced with other coalesced events or first level events into higher coalesced events. For example, coalesced event 670 and first level events 650-660 may be coalesced into coalesced event 680, "C has picked up lunch."

Coalesced events may further be defined by a chronological time range within which the defining events must occur. For example, coalesced event 670 may require that the defining first level events 610-640 all occur with 0.15 minutes of each other in order to be identified as the coalesced event "C has entered home." Coalesced events may also include other rules in their definition, for example, a rule specifying that two or more of the defining events occur in a particular order, or that only a portion of the defining events occur within a given time range, or that two or more defining events occur outside of a given time range between each other, or a require a certain system/subsystem state have a certain value, etc.

Coalesced events may also be identified based on one or more relationship rules, as one alternative to pre-defined coalesced event definitions. Relationship rules may indicate types of events that may be coalesced rather than specifically defining the events that constitute up a given coalesced event. Chronological requirements or restrictions may be incorporated in relationship rules. For example, the coalescence component 590 may analyze the event log to determine whether a first type of event has occurred subject to a relationship rule, and further determine whether a second event related to the first event has occurred within a predetermined time range of the first event. When two related events are found within the required time range, the coalescence component 590 may determine that a hierarchically higher level event has occurred and coalesce the first and second events. For example, a set of four sprinklers may be arranged in quadrants of a yard. A relationship rule may specify that events triggered by a change in state of system components that are disposed within a given portion of the premises and that all share the same function are related if they function simultaneously or within a pre-determined time range of each other. Under this rule, each individual sprinkler may turn on, but rather than generate four different "sprinkler on" events, the coalescence component 590 may coalesce the four events into a single "front lawn sprinklers on" coalesced event.

The smart notification system 580 may record a chronological event log 700 (FIG. 5B) of events in order to determine when events may be coalesced to a higher level. Referring to FIG. 3, the event log may be stored, for example, in memory 76, in remote system 74, or any other accessible data storage device.

FIG. 7 shows an example event log 700. An event log component 584 (FIG. 5B) may record events 710-740 in the event log 700. As events are recorded, the smart notification system 580 may include a coalescence component configured to constantly analyze the data and determine whether logged events meet the definition of a coalesced event. At 11:03:07 AM, the coalescence component determines that events 710-740 meet the definition requirements of the coalesced event "C has arrived home," therefore the event 750 is recorded in the event log 700.

In addition to recording first level events and coalesced events, the smart notification system 580 may also record "custom events" in the event log 700. A custom event refers to an event with parameters that are defined by a user. The availability of custom events may depend upon the feature set in the premises management devices presently in the premises management system. Different devices may provide the option of defining different parameters, including temperature, sound level, motion, time, identification or device specific feature parameters. For example, a camera may have the option of defining a custom zone within the field of view. By setting/adjusting this parameter, any activity within a custom zone may serve as the defining activity of a custom event. Referring to FIG. 5A, a camera 170 in the kitchen 520 may define a custom zone "Z" on a counter space where a lunch bag has been placed. When the lunch bag is removed from the custom zone Z, the smart notification system 580 may record this activity as a custom event "Item removed from counter" 770 in event log 700 (FIG. 7).

Coalesced event definitions may be created automatically by the smart notification system 580. For example, the system may include an event generator component 588 configured to analyze the event log to search for patterns in the events. The patterns may cover any number of sequences or relationships, including immediately consecutive events, e.g., [A-B-C], or a group of events that are not immediately consecutive but occur in an order within a time frame, e.g., [A-(X-X)-B-C], [A-(Y-Y)-B-C], where intervening events (X-X) or (Y-Y) may vary. Any of various algorithms may be used to dynamically identify groups of events that may be coalesced. The smart notification system 580 may therefore be configured to "learn" to improve reporting efficiency by automatically coalescing events, or may be configured to forgo this feature, or configured to recommend potential coalesced events to the user for instructions, e.g., approval, naming, adjustment, or denial.

Custom coalesced event definitions may also be created by an admin or a user or imported in from an external system or device. A custom definition may include any combination of first level events, custom events, and/or coalesced events, regardless of whether any pattern of such exists in the event log 700. For example, referring to FIGS. 5A, 6 and 7, a camera 170 placed in the kitchen 520 having custom zone Z may obtain information to determine whether custom event "Item removed from counter" has occurred. A user may create a custom coalesced event "C has picked up his lunch" defined by the occurrence of coalesced event "C has arrived home", first level event "Individual in kitchen" and custom event "Item removed from counter" all within a 0.5 minute time frame. Accordingly, when the definition is met the smart notification system 580 records the custom coalesced event 780 "C has picked up lunch" in the event log.

The smart notification system 580 may include a communication component 594 configured to send notifications to one or more users. The notifications may include information regarding any type of event, including any first level event detected by any premises management device, any coalesced event, or any custom defined event or custom defined coalesced event. For example, notified events could include "Front door open" based on information detected by an entry detection unit, or "Smoke in the den" from information detected by a hazard detector unit, or any of the example events discussed above.

In addition to reporting events, smart notifications system may include a status component to monitor the system and generate system reports that provides a maintenance status of one or more components of the premises management system or a service associated with the premises management system. The system reports may be included in notifications. For example, a system report in a notification could include "Battery low in hallway hazard detection unit," "Filter needs to be replaced in three days," or "Cloud subscription fee for data storage due in three days."

The communication component 594 may access the event log 700 and, based on the log data, transmit to one or more users notifications of a hierarchically highest level event determined to have occurred within a pre-determined time range or of any particular event/custom event for which notification has been requested by a user. For example, the communication component 594 may advance through the event log constantly checking the events against known notifications. The communication component 594 may operate under any of various rules or algorithms to search for potential coalesced events. For example, the communication component 594 may communicate with the coalescence component 590 and delay reporting any event that appears to match an initial definition of a coalesced event or appears to fall within the bounds of a relationship rule until either all coalesced events are ruled out and all relationship rules are invalidated, or until a pre-determined amount of time has transpired. Thus, the communication component 594 may be configured to only communicate notifications of a hierarchically highest level event determined to have occurred during a pre-determined time range. In this manner the smart notification system 580 mitigates against inundating the selected user with relatively excessive and repetitive notifications. Additional reporting restrictions may be applied to further cull the number of notifications, for example, the communication component 594 may be configured to only report a limited set of events, e.g., only pre-defined coalesced events, only second level and above coalesced events, only events related to a designated section of the premises or subsystem of the premises management system, only select events/custom events designated by one or more users, etc.

By scanning the event log 700 using a matching/process of elimination algorithm, the smart notification system 580 may also provide notifications of multiple coalesced events simultaneously occurring in or around the premises as defined events are identified and/or relationship rule requirements are met.

Notifications may correspond to any type of event or may include system status reports from the status component 592. The communication component 594 may store or have access to different types of notifications available in a given implementation of the smart notification system 580. In order to determine the most appropriate user to receive a particular notification, notifications may be further defined to include a number of parameters. Several notification parameters will now be described. A notification definition may include one or more parameters, or no parameters, in which case a default one or more recipients may be selected, for example, admin only or all users. Although the parameters are described below in terms of first, second, etc., the numerical designation has no bearing or restriction on the parameter and is merely used here as differentiating nomenclature.

A first parameter may be a profile parameter. By setting this parameter, notifications may be classified under profiles according to the type of user most likely to be interested in receiving the notification. For example, a "head of household" classification may include notifications and system reports related to expenses and maintenance of the premises management system while a "caregiver" classification may include notifications related to monitoring children's rooms and play areas.

A second notification parameter may be an ordered list of priority recipients. This parameter may include the potential recipients of the notification listed in order of priority, meaning that recipients to whom the notification would likely be most critical or are most likely to be responsive are listed higher on the list while the recipients to whom the notification would be less critical or are less likely to be responsive are listed lower on the list. The list may or may not be designated as exclusive. An exclusive list indicates that only users included on the list may receive the notification. A nonexclusive list indicates that the listed recipients are the most important potential recipients but other recipients may be allowed to receive the notification as well if other reasons are applicable, for example, based on the profile parameter. The list order may be locked or the list order may be adjustable by the system.

A third notification parameter may be a vicinity parameter. This parameter indicates whether the notification should be communicated to recipients "within," "without," or "either within/without" the vicinity of the premises. For example, a notification with the vicinity parameter set to "within" would not be sent to a user's registered device if the device is determined to be outside of the premises.

A fourth notification parameter may be a maximum/minimum recipient parameter. This parameter would designate the maximum and minimum number of recipients that may receive the notification. For example, if the notification is highly sensitive a maximum of one recipient may be set, relying on the smart notification system 580 to use the balance of other parameters to determine the single best recipient to receive the notification.

A fifth notification parameter may be a custom parameter based on either the state of the premises management system, the state of a subsystem (e.g., the security subsystem), or the state of a particular premises management device. For example, a notification may be designated to not be sent unless the security system is in an alarm mode, or unless the temperature detected by a thermostat unit is above or below a certain threshold value.

A sixth notification parameter may be an urgency parameter. This parameter may indicate how urgent or negligible a given notification is. For example, a notification of detection of fire in the premises may be designated a relatively high urgency parameter value while a notification of low batteries in smart thermostat may be designated a relatively low urgency parameter value. The urgency parameter may be set by the user, set by the system to a default value, or set by the smart notification system 580 to a best estimate of an appropriate value based on the current implementation and historical data. Furthermore, the urgency parameter may be adjusted, for example by the user or by the smart notification system 580 in response to feedback from one or more users, as will be discussed further below.

A seventh notification parameter related to the sixth may be an escalation parameter. This parameter may indicate that the urgency parameter should be increased if the analysis of a notification results in no suitable recipient being found or selected. For example, there may be certain types of notifications that a user would prefer other users attend to if possible, however, if no other user is available, the user will obligatorily respond.

An eighth notification parameter may be a delivery method parameter. This parameter may include a list of possible deliver methods to be cross checked against other factors in order to determine the optimal delivery method at the time of the notification. Cross-checked factors may include other notification parameters, user profile preferences (discussed below), historical events as recorded in the event log 700, and/or a state of one or more system/subsystem components. Furthermore, a delivery method parameter may be designated as subordinate to a user preference or permitted to override a user preference. For example, a notification may a delivery method parameter that indicates that a user preference delivery method should be executed when a user is not within the premises but a local system speaker delivery method should be executed when the user is detected within the premises.

Notification parameters in general may be set in any number of ways. For example, any of the parameters may be set by a user, set by a manufacturer automatically to default values, or set to estimation values by the smart notification system 580 based on common settings in a given implementation and/or historical data. Based at least in part on the notification parameters, the smart notification system 580 may make execute various algorithms to make an initial determination of the most appropriate user(s) to send any given notification to. In addition, the smart notification system 580 may take into account user profile designations, user account parameters, feedback from the user regarding relevancy, and estimations based on historical data.

Authorized users of the smart notification system 580 may create accounts in a user account database 596. When a user creates an account, the user may have profiles associated with the user's account in any of several ways, for example, by selecting the profiles himself or herself, by having such profiles assigned by an admin, or by having the profiles assigned by default by the smart notification system's 580 best estimate of what an average new user of the system would find relevant, which may vary among implementations of the system. The profile may function as a classification of the type of user and indicate what type of notifications are relevant to the user. For example, an "admin" profile could be an indication that maintenance and financial status reports are relevant to this user. On the other hand, a "guest" profile could indicate that only a limited number of emergency level notifications are appropriate for this user. As such, the smart notification system 580 can determine appropriate recipients based in part on a classification of a user as indicated by the profile.

A user account may include variable parameters that the smart notification system 580 may weigh in algorithms to determine whether a user is an appropriate recipient of a notification. The parameters could include, for example, a user mood status, a user preferred device parameter, and a user location status.

A mood status parameter may indicate whether a user is in the mood to receive notifications. For example, a mood status may indicate that a user only desires all notifications, or to only receive notifications of a certain urgency level, or to receive no notifications at all.

A preferred device parameter may indicate the user's preferred device for receiving notifications, e.g., via text message to a cell phone, email, electronic message to a messaging system accessible through a web portal, a controller device of the system, or any other capable premises management device or computing device. For example, referring to FIG. 5A, User A may designate a preference of receiving notifications via controller device 160, User B may designate a preference of receiving notifications in text message format via mobile phone 180, and User C may designate a preference of receiving notifications in audible format via hazard detection unit 130. The preferred device parameter may also indicate a method, process or style of the communication to the preferred device. For example, the parameter may include a phone number and indicate that the preferred style is via text messaging.

A user location status parameter may indicate that the user is in a particular location. In some instances this parameter may be updated by the system. For example, the system may determine a location of a user as being in or around the premises based on information obtained from sensors or by detecting a communication device, such as a card or key fob carried by the user. In other instances the location status parameter may be updated by the user, e.g., manually or automatically via a preferred device. For example, in the case that a user designates a smart device, such as a mobile phone, media player or wearable technology, as the user's preferred device, the device may communicate with the system to improve the accuracy of the smart notification system 580. One such communication may include an update of the user location parameter. In one scenario, a wearable technology such as a smart watch may automatically update the location status parameter of the user account in a cloud-based account. In that case, if the user does not want to receive certain notifications in a given location, the smart notification system 580 may implement this restriction.

Figure 8:
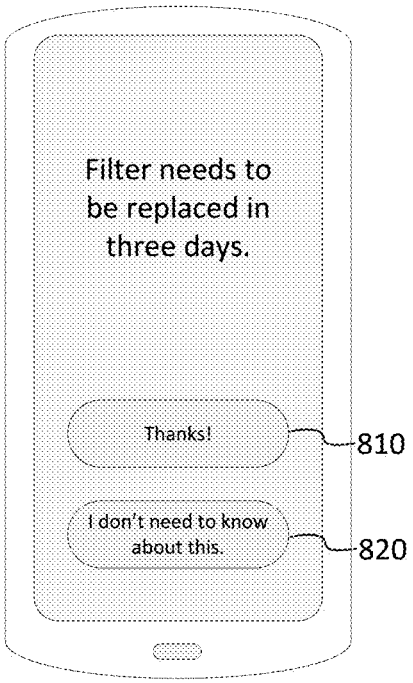
FIG. 8 shows an interface in which a user may receive a notification from the smart notification system according to an embodiment of the disclosed subject matter.

Users may provide feedback to the smart notification system 580 regarding the relevance or appropriateness of a given notification to the user. Referring to FIG. 8, an example interface is shown in which a user may receive a notification from the smart notification system 580 via a cell phone 800. When the user receives a notification, the user may respond by indicating that the notification has been viewed and is relevant to the user's attentions, for example, in this case by selecting option 810. The user may also respond by indicating that the user would prefer not to receive that particular notification again, for example, in this case by selecting option 820. Depending on the type of notification other options may be available, such as a request to be reminded later, or a request to redirect the notification to another user, or a request to receive additional notifications of a similar nature. The smart notification system 580 may adjust the user's account and/or the notification itself based on the user's responses to the received notifications. For example, the smart notification system 580 may adjust an urgency level parameter of a notification if multiple users repeatedly indicate that the notification is not relevant or appropriate.

Accordingly, the smart notification system 580 may execute complex algorithms and reach intricate and precise levels of decision-making in determining notification recipients in a mired of situations that may arise in a premises management system. It is possible, for example, using the priority list, minimum/maximum, urgency, escalation, and vicinity notification parameters, along with custom events and user mood parameters, for the system to select a recipient of a notification based on locations of one or more users relative to each other. Such a feature could arise in a practical scenario in which the system notifies only a mother of a baby crying when the mother is home and the father is not home, and vice versa only notifies the father when the father is home and the mother is not home, but may notify both when both are away. Only the most appropriate user may be notified in this situation unless the urgency is escalated (since neither is within the vicinity) such that it requires that both be notified.

While complex decision-making is possible within the smart notification system 580, much of the complexity may be invisible to the user. After initial default settings are established, many of the adjustments to the system may take place based on the user(s) response to the notifications and the historical data that is accumulated. Furthermore, simple interfaces may be provided for the user to change a profile, create a custom event, or the like. Such interfaces may be included in, for example, a web page, a mobile device application, or a special interface designed as part of the user interface of a controller device or other computing device of the system.

In situations in which the systems discussed here collect personal information about users, or may make use of personal information, the users may be provided with an opportunity to control whether programs or features collect user information (e.g., information about a user's social network, social actions or activities, profession, a user's preferences, or a user's current location), or to control whether and/or how to receive content from the content server that may be more relevant to the user. In addition, certain data may be treated in one or more ways before it is stored or used, so that personally identifiable information is removed. For example, specific information about a user's residence may be treated so that no personally identifiable information can be determined for the user, or a user's geographic location may be generalized where location information is obtained (such as to a city, ZIP code, or state level), so that a particular location of a user cannot be determined. As another example, systems disclosed herein may allow a user to restrict the information collected by those systems to applications specific to the user, such as by disabling or limiting the extent to which such information is aggregated or used in analysis with other information from other users. Thus, the user may have control over how information is collected about the user and used by a system as disclosed herein.

Various embodiments of the presently disclosed subject matter may include or be embodied in the form of computer-implemented processes and apparatuses for practicing those processes. Embodiments also may be embodied in the form of a computer program product having computer program code containing instructions embodied in non-transitory and/or tangible media, such as hard drives, USB (universal serial bus) drives, or any other machine readable storage medium, such that when the computer program code is loaded into and executed by a computer, the computer becomes an apparatus for practicing embodiments of the disclosed subject matter. When implemented on a general-purpose microprocessor, the computer program code may configure the microprocessor to become a special-purpose device, such as by creation of specific logic circuits as specified by the instructions.

Embodiments may be implemented using hardware that may include a processor, such as a general purpose microprocessor and/or an Application Specific Integrated Circuit (ASIC) that embodies all or part of the techniques according to embodiments of the disclosed subject matter in hardware and/or firmware. The processor may be coupled to memory, such as RAM, ROM, flash memory, a hard disk or any other device capable of storing electronic information. The memory may store instructions adapted to be executed by the processor to perform the techniques according to embodiments of the disclosed subject matter.

The foregoing description, for purpose of explanation, has been described with reference to specific embodiments. However, the illustrative discussions above are not intended to be exhaustive or to limit embodiments of the disclosed subject matter to the precise forms disclosed. Many modifications and variations are possible in view of the above teachings. The embodiments were chosen and described in order to explain the principles of embodiments of the disclosed subject matter and their practical applications, to thereby enable others skilled in the art to utilize those embodiments as well as various embodiments with various modifications as may be suited to the particular use contemplated.

The invention claimed is:

1. A system, comprising:

one or more sensors to gather information about an environment;

a memory device that stores one or more computer executable components; and a processor to execute the following computer executable components in the memory:

an event detection component to obtain information from the one or more sensors and identify whether a first level event has occurred based on the obtained information, a coalescence component to consolidate a plurality of events into a hierarchically higher-level, pre-defined coalesced event, and a communication component to send to one or more users a notification of a hierarchically highest level event determined to have occurred during a pre-determined time range, wherein the communication component receives a communication from one of the one or more users indicating that the user prefers not to receive notifications of the event and prevents further notifications of the event from being communicated to the user.

2. The system of claim 1, wherein the communication component selects the one or more users from among a plurality of users accounts based at least in part on user account data that includes a profile indicating a classification of the user.

3. The system of claim 2, wherein the plurality of user accounts each include a location parameter that indicates a location of the corresponding user.

4. The system of claim 2, wherein the plurality of user accounts each include a preferred device parameter that indicates a type of device through which the user prefers to receive the notification and a style of the notification.

5. The system of claim 1, further comprising:

a log component to record a data log of detected events and coalesced events along with corresponding times that the detected events and coalesced events occurred; and an event generator component to identify patterns in the data log and create new coalesced event definitions based on the identified patterns.

6. The system of claim 1, further comprising:

a status component to generate a status report that provides information on a status of the system or a component of the system, wherein the communication component sends the status report to the one or more users in the notification.

7. The system of claim 6, wherein the status reports include maintenance reports on system components and financial reports regarding billing costs associated with the system.

8. The system of claim 6, wherein the notification includes one or more parameters that indicate a type of recipient likely to find the notification relevant or indicate a restriction on the recipient, and the communication component selects the one or more users based at least in part on the one or more parameters.

9. The system of claim 8, wherein the one or more parameters is selected from a group consisting of: a profile parameter that indicates a type of recipient, an ordered list of priority recipients, a vicinity parameter that indicates where a recipient should be, a maximum/minimum number of recipient, a custom parameter based on a state of the system or a device in the system, and an urgency parameter indicating a level of urgency of the notification.

10. The system of claim 1, wherein the event detection component obtains information from the one or more sensors based on a time of day.

11. The system of claim 1, wherein the event detection component obtains information from the one or more sensors based on a power or battery level of the one or more sensors.

12. A method comprising:

obtaining information from one or more sensors about an environment;

determining whether a first event has occurred based on the obtained information;

determining whether a second event related to the first event occurred within a pre-determined time range of the first event based on the obtained information;

determining whether a hierarchically higher level event comprising the first event and the second event has occurred; and communicating, to one or more users, a notification of a hierarchically highest level event determined to have occurred during a pre-determined time range.

13. The method of claim 12, wherein the one or more users are selected based on a present location of the one or more users.

14. The method of claim 12, wherein the one or more users are selected based on a classification of the one or more users.

15. The method of claim 12, wherein the one or more users are selected based on locations of the one or more users relative to each other.

16. The method of claim 12, further comprising:

receiving a communication from one of the one or more users indicating that the user prefers not to receive notifications of the event; and preventing further notifications of the event from being communicated to the user.

17. The method of claim 12, wherein the information is obtained from the one or more sensors based on a time of day.

18. The method of claim 12, wherein the information is obtained from the one or more sensors based on a power level of the one or more sensors.

19. A system comprising:

one or more sensors to obtain information about an environment;

a memory device that stores one or more computer executable components; and a processor to execute the following computer executable components in the memory:

an event detection component to obtain information from the one or more sensors and identify whether a first level event has occurred and whether a second event related to the first event has occurred within a pre-determined time range of the first event based on the obtained information, a coalescence component to determine whether a hierarchically higher level event comprising the first event and the second event has occurred, and a communication component to send to one or more users a notification of a hierarchically highest level event determined to have occurred during a pre-determined time range.

20. The system of claim 19, wherein the communication component selects the one or more users from among a plurality of users accounts based at least in part on user account data that includes a profile indicating a classification of the user.

21. The system of claim 20, wherein the plurality of user accounts each include a location parameter that indicates a location of the corresponding user.

22. The system of claim 20, wherein the plurality of user accounts each include a preferred device parameter that indicates a type of device through which the user prefers to receive the notification and a style of the notification.

23. The system of claim 19, further comprising:

a status component to generate a status report that provides information on a status of the system or a component of the system, wherein the communication component sends the status report to the one or more users in the notification.

24. The system of claim 23, wherein the status reports include maintenance reports on system components and financial reports regarding billing costs associated with the system.

25. The system of claim 23, wherein the notification includes one or more parameters that indicate a type of recipient likely to find the notification relevant or indicate a restriction on the recipient, and the communication component selects the one or more users based at least in part on the one or more parameters.

26. The system of claim 25, wherein the one or more parameters is selected from a group consisting of: a profile parameter that indicates a type of recipient, an ordered list of priority recipients, a vicinity parameter that indicates where a recipient should be, a maximum/minimum number of recipient, a custom parameter based on a state of the system or a device in the system, and an urgency parameter indicating a level of urgency of the notification.

* * * * *